US007398697B2

(12) United States Patent
Allen et al.

(10) Patent No.: US 7,398,697 B2
(45) Date of Patent: Jul. 15, 2008

(54) APPARATUS AND METHOD FOR RETROACTIVELY INSTALLING SENSORS ON MARINE ELEMENTS

(75) Inventors: Donald Wayne Allen, Houston, TX (US); David Wayne McMillan, Deer Park, TX (US)

(73) Assignee: Shell Oil Company, Houston, TX (US)

( * ) Notice: Subject to any disclaimer, the term of this patent is extended or adjusted under 35 U.S.C. 154(b) by 69 days.

(21) Appl. No.: 11/265,889

(22) Filed: Nov. 3, 2005

(65) Prior Publication Data

US 2006/0115335 A1 Jun. 1, 2006

Related U.S. Application Data

(60) Provisional application No. 60/624,736, filed on Nov. 3, 2004.

(51) Int. Cl.
*G01L 1/24* (2006.01)

(52) U.S. Cl. ..... 73/800

(58) Field of Classification Search ..... 73/800
See application file for complete search history.

(56) References Cited

U.S. PATENT DOCUMENTS

| | | | | |
|---|---|---|---|---|
| 3,899,991 | A | 8/1975 | Chatten et al. | 114/235 |
| 3,910,110 | A | 10/1975 | Jefferies et al. | 73/155 |
| 4,194,401 | A | 3/1980 | Claassen et al. | 73/730 |
| 4,205,379 | A | 5/1980 | Fox et al. | 364/432 |
| 4,217,782 | A | 8/1980 | Pont | 73/637 |
| 4,317,174 | A | 2/1982 | Dean | 364/432 |
| 4,351,027 | A | 9/1982 | Gay et al. | 364/432 |
| 4,398,487 | A | 8/1983 | Ortloff et al. | 114/243 |
| 4,636,638 | A | 1/1987 | Huang et al. | 250/231 R |
| 4,654,520 | A | 3/1987 | Griffiths | 250/227 |
| 4,731,744 | A | 3/1988 | Harrell, Jr. et al. | 364/560 |
| 4,793,737 | A | 12/1988 | Shotbolt | 405/169 |
| 4,812,645 | A | 3/1989 | Griffiths | 250/227 |
| 5,006,845 | A | 4/1991 | Calcar et al. | 340/853 |
| 5,026,141 | A | 6/1991 | Griffiths | 350/96.29 |
| 5,410,979 | A | 5/1995 | Allen et al. | 114/243 |
| 5,421,413 | A | 6/1995 | Allen et al. | 166/335 |

(Continued)

FOREIGN PATENT DOCUMENTS

JP 2000075174 3/2000

(Continued)

OTHER PUBLICATIONS

Remo Z. Machado et al. "Monitoring Program for the First Steel Catenary Riser Installed in a Moored Floating in Deep Water", pp. 801-810.

(Continued)

*Primary Examiner*—Edward Lefkowitz
*Assistant Examiner*—Octavia Davis
(74) *Attorney, Agent, or Firm*—William E. Hickman

(57) ABSTRACT

Sensors, including fiber optic sensors and their umbilicals, are mounted on support structures designed to be retro-fitted to in-place structures, including subsea structures. The sensor support structures are designed to monitor structure conditions, including strain, temperature, and in the instance of pipelines, the existence of production slugs. Moreover the support structures are designed for installation in harsh environments, such as deep water conditions using remotely operated vehicles.

19 Claims, 11 Drawing Sheets

U.S. PATENT DOCUMENTS

| | | | | |
|---|---|---|---|---|
| 5,525,796 | A | 6/1996 | Haake | 250/227.15 |
| 5,845,033 | A | 12/1998 | Berthold et al. | 385/12 |
| 5,875,728 | A | 3/1999 | Ayers et al. | 114/264 |
| 6,010,278 | A | 1/2000 | Denison et al. | 405/216 |
| 6,092,483 | A | 7/2000 | Allen et al. | 114/264 |
| 6,179,524 | B1 | 1/2001 | Allen et al. | 405/211 |
| 6,196,768 | B1 | 3/2001 | Allen et al. | 405/224 |
| 6,223,672 | B1 | 5/2001 | Allen et al. | 114/243 |
| 6,227,137 | B1 | 5/2001 | Allen et al. | 114/264 |
| 6,263,824 | B1 | 7/2001 | Balint et al. | 114/264 |
| 6,276,456 | B1 | 8/2001 | Head | 166/359 |
| 6,278,811 | B1 * | 8/2001 | Hay et al. | 385/13 |
| 6,309,141 | B1 | 10/2001 | Cox et al. | 405/224 |
| 6,332,361 | B1 | 12/2001 | Yamada et al. | 73/627 |
| 6,551,029 | B2 | 4/2003 | Shu et al. | 405/211 |
| 6,561,734 | B1 | 5/2003 | Allen et al. | 405/216 |
| 6,565,287 | B2 | 5/2003 | McMillan et al. | 405/211.1 |
| 6,571,878 | B2 | 6/2003 | Mc Daniel et al. | 166/367 |
| 6,644,894 | B2 | 11/2003 | Shu et al. | 405/211 |
| 6,685,394 | B1 | 2/2004 | Allen et al. | 405/211 |
| 6,695,539 | B2 | 2/2004 | McMillan et al. | 405/191 |
| 6,695,540 | B1 | 2/2004 | Taquino | 405/216 |
| 6,702,026 | B2 | 3/2004 | Allen et al. | 166/367 |
| 6,868,737 | B2 | 3/2005 | Croteau et al. | 73/800 |
| 6,886,487 | B2 | 5/2005 | Fischer, III | 114/230.1 |
| 6,889,562 | B2 * | 5/2005 | Gysling et al. | 73/861.42 |
| 6,928,709 | B2 | 8/2005 | McMillan et al. | 29/281.1 |
| 6,959,604 | B2 | 11/2005 | Bryant et al. | 73/705 |
| 6,994,492 | B2 * | 2/2006 | McMillan et al. | 405/216 |
| 7,017,666 | B1 | 3/2006 | Allen et al. | 166/367 |
| 7,070,361 | B2 | 7/2006 | McMillan et al. | 405/211 |
| 2003/0230409 | A1 | 12/2003 | Guesnon et al. | 166/335 |
| 2004/0020653 | A1 | 2/2004 | Smith | 166/366 |
| 2004/0035216 | A1 | 2/2004 | Morrison et al. | 73/800 |
| 2005/0005712 | A1 | 1/2005 | Gysling et al. | 73/861.23 |
| 2005/0175415 | A1 | 8/2005 | McMillan et al. | 405/211 |
| 2005/0254903 | A1 | 11/2005 | McMillan et al. | 405/216 |
| 2006/0021560 | A1 | 2/2006 | McMillan et al. | 114/221 |
| 2006/0115335 | A1 | 6/2006 | Allen et al. | 405/274 |
| 2006/0177275 | A1 | 8/2006 | Allen et al. | 405/224.2 |

FOREIGN PATENT DOCUMENTS

| | | |
|---|---|---|
| WO | WO9302916 | 2/1993 |
| WO | 00/68657 | 11/2000 |

OTHER PUBLICATIONS

International Search Report for TH2626 PCT dated May 4, 2006.
Written Opinion for TH2626 PCT dated May 4, 2006.
Vortex—Induced Vibrations Suppression of Cylindrical Structures by D. W. Allen, Apr. 1994.

* cited by examiner

APPARATUS AND METHOD FOR RETROACTIVELY INSTALLING SENSORS ON MARINE ELEMENTS

RELATED APPLICATIONS

This application claims priority to the provisional application having Ser. No. 60/624,736, which was filed on Nov. 3, 2004. The provisional application having Ser. No. 60/624,736 is herein incorporated by reference in its entirety.

The application is also related to the subject matter disclosed in U.S. application Ser. No. 10/228,385, filed 26 Aug. 2002, the subject matter of which is herein incorporated by reference.

FIELD OF THE INVENTION

The present invention relates to apparatus and methods for monitoring fatigue, structural response and operational limits in structural components. More particularly the present invention relates to apparatus and methods for installation of monitoring systems on marine and land structural members.

DESCRIPTION OF THE RELATED ART

All structures respond in some way to loading, either in compression, tension, or combinations of various loading modes. While most structures and systems are designed to accommodate planned loading, it is well known that loads exceeding design limits or continued cyclical loading may induce fatigue in the structure. While some structures may be readily monitored for signs of fatigue, others are not easily monitored. Examples include subsea structures, such as pipelines, risers, wellheads, etc.

In most instances, monitoring systems are installed when the structure is installed or constructed. However, there exists a system of subsea risers, pipelines and other structures that have already been installed without the benefit of monitoring systems. These subsea components are subject not only to normal planned current or wave loading, but met ocean events, such as hurricanes, or sustained cyclical loading from vortex induced vibration (VIV) loading.

A major concern in all offshore operations is the operational life of subsea components. A fatigue-induced failure can result in a substantial economic loss as well as an environmental disaster should produced hydrocarbons be released into the sea. When a subsea production structure is nearing the end of its serviceable life or has suffered substantial fatigue, producing companies are likely to shut-in production rather than run the risk of a catastrophic failure. This can result in substantial financial losses to the producing company.

Currently, most subsea structures, such as risers and pipelines, including steel catenary risers, are not monitored. Structural integrity of such bodies is modeled, based on known loading factors, sea state data, and boundary conditions. Because there is no direct measurement of strain or fatigue in these structures, high safety factors, on the order of 10 to 20, are factored into these models. It will be appreciated that as the models indicate that a structure is nearing the end of its serviceable life or has undergone unacceptable fatigue, the choice for the production company is to repair or replace the structure or to shut-in production. In some instances, the structural integrity is far better than the models may predict. This means that the producing companies may be incurring substantial expense in repairing or replacing the structures or losses from shutting in production. The alternative, a loss of containment of produced hydrocarbons, would, however, subject any producing company to far greater liability costs when compared to repair, replacement or shut-in.

Recently efforts have been made to develop monitoring systems for subsea structures. U.S. Patent Publication 2004/0035216, published 26 Feb. 2004, U.S. application Ser. No. 10/228,385, entitled Apparatuses and Methods for Monitoring Stress in Steel Catenary Risers, which is herein incorporated by reference in its entirety, describes an apparatus and method for monitoring subsea structures utilizing a series of fiber optic Bragg grating (FBG) sensors to measure strain in several directions on a subsea structure. The design and use of FBG sensors is discussed within the '385 application. Multiple fiber optic strands from a centralized fiber bundle have a Bragg grating applied to them and are attached to the subsea structure. Small gratings are etched on the fibers where attached to the structure. As a light is applied to the fiber a return signal is received. As a strain is applied to the structure, the grating is likewise strained and the returned signal undergoes a frequency shift that is proportional to the strain. The aforementioned application discloses the performance of the FBG sensors and a means for attaching them to the structure. It will be appreciated that by obtaining actual strain data, the models used to determine serviceable life are more accurate and the safety factors can be reduced to manageable levels. As, such, producing companies are more likely to reduce repair/replacement costs or shut-in losses without substantially increasing environmental risk.

Thus, there exists a need for an improved method and apparatus to permit retrofit of an FBG or other sensor monitoring system that can be adapted to structures already in place.

SUMMARY OF THE PRESENT INVENTION

The present invention is directed to a means of retrofitting sensors to installed marine elements. More particularly, the present invention utilizes a set of collars that may be remotely installed on subsea structures. One or more fiber optic sensors and umbilicals leading to a system are affixed to the structure by means of multipart collars. The collars may be hingeable for ease of installation or may be assembled as separate items. The umbilical acts as a protective sleeve for the fiber optic sensor and its fiber optic communication line. The sensors may be bonded internal to the the umbilical. Moreover, the fiber optic sensors may be of the FBG type previously disclosed, or may be of the Fabry Perot (FP) interferometer type. The nature of FP sensors is well known to those of ordinary skill in the art. In a Fabry Perot sensor, light is reflected between two partially silvered surfaces. As the light is reflected, part of the light is transmitted each time it reaches the surface, resulting in multiple offset beams that set up an interference. The performance of FP sensors is similar in that relative movement between the two silvered surfaces will result in a change of wavelength of the light.

The present invention contemplates that the fiber optic sensors and their umbilicals are secured to the collars or other support structures. The support structure is then deployed subsea and installed on an existing subsea structure. The umbilicals may be removably attached to the support structure. This permits subsequent replacement of a sensor/umbilical in the event of failure. Alternatively, it permits installation of the sensor/umbilical following attachment of the support structure to the structure. In the present invention, multiple sensor/umbilical pairs may be attached to a single support structure. When the support structure is attached to the subsea structure, the sensors are fixed in position relative to the subsea structure. It will be appreciated that multiple support structures/umbilical/sensor assemblies may be attached to the subsea structure, thereby permitting strain monitoring along the length of the subsea structure. The flexibility of support structure design and attachment scheme of the sensor/umbilical pairs permits the user to design a custom monitoring system for the subsea structure.

In one application, the present invention may provide a large and dense array of sensors over a relatively small portion of the structure. In the case of a subsea pipeline or a riser, this type of deployment could be used to determine not only strain from physical forces (physical loading and current forces) but may be used to detect large volumes of denser production (slugs) as they pass through the monitored section. As the slugs pass through a pipeline, the internal pressure within the pipe increases, resulting in detectable strain in the pipe internal and external walls. This strain may be detected by the sensors arrayed to measure hoop strain and may be recorded by the monitoring system. As the slug passes down a pipeline, it will be detected by subsequent sensors. The design of a sensor array and its placement along a pipeline section may be used to characterize the slug velocity and size.

In another application, the present invention may provide for multiple support structures over long spans of the structure. In the case of SCRs, it would permit monitoring strain across the touch down zone. This type of application would also permit monitoring of the effects of temperatures on a subsea element. It will be appreciated that high temperature/high pressure well production may have hydrocarbon production temperatures in the range of 200° to 350° F. This production may be rapidly cooled as it passes through subsea flow lines to production risers. The effect of this rapid temperature change on subsea equipment is poorly documented. It will be appreciated that the failure of a piece of subsea equipment due to temperature failure would have a disastrous effect on the environment.

While the foregoing and following discussion focuses on the use of fiber optic FBG and FP sensors, it will be appreciated that the sensors described herein may include hybrid sensors, i.e., fiber optic sensors in combination with other types of transducers including a means for converting the transducer signal for transmission through a fiber optic medium.

The foregoing summary has outlined rather broadly the features and technical advantages of the present invention so that the detailed description of the preferred embodiment that follows may be better understood. Additional features and advantages of the invention will be described hereinafter, which form the subject of the invention. It should be appreciated by those skilled in the art that the conception and the specific embodiments disclosed might be readily used as a basis for modifying or designing other apparatuses and methods for carrying out the same purposes of the present invention. It should also be realized by those skilled in the art that such equivalent constructions do not depart from the spirit and scope of the invention as set forth and claimed herein.

BRIEF DESCRIPTION OF THE DRAWINGS

The accompanying drawings, which are incorporated in and form a part of the specification, illustrate the embodiments and applications of the present invention, and, together with the detailed description, serve to explain the invention. In the drawings.

DETAILED DESCRIPTION OF THE PREFERRED EMBODIMENT

In one embodiment the structure to which the monitoring system is attached is discussed in terms of a tubular subsea element. However, it will be appreciated that the structure need not be tubular. The specific geometry of the support structure and the means of securing it about the structure may be readily varied to the geometry of the structure. Moreover, the structure need not be limited to a subsea element, as the same principles would operate with a horizontal or vertical structure, subsea or on the land.

Figure 1B:
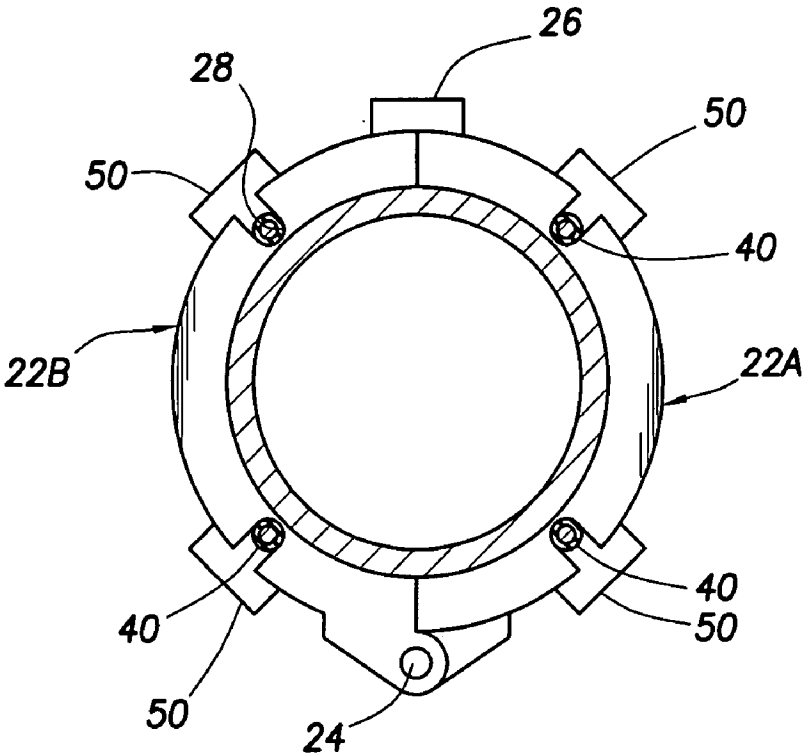
FIGS. 1A and 1B are side and top views, respectively, of a cutaway section of a tubular showing one embodiment of the present invention.
Figure 1A:
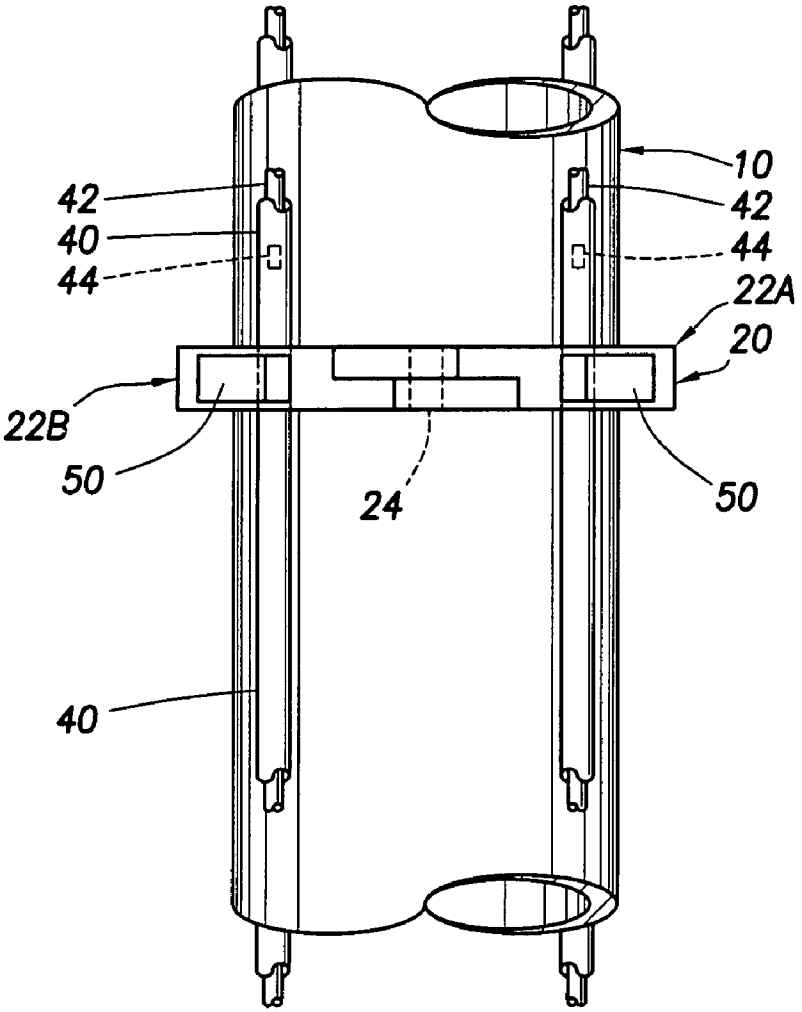

In FIGS. 1A and 1B, a cutaway of a subsea element 10 is shown with one embodiment of the monitoring system of the present invention mounted thereon. A collar 20 is shown comprised of two collar sections 22A and 22B. The collar sections 22A and 22B each have a hinge portion built therein and are pinned together by pin 24, thus allowing the collar sections 22A and 22B to open and close tightly about the vertical element 10. It will be appreciated that a deformable material such as rubber or plastic may be placed on the internal surfaces of collar sections 22A and 22B. The material is deformed against the outer surface of the subsea element 10 when the collar 20 is closed thereabout, thereby further securing the collar 20 against movement relative to the subsea element 10. The pin 24 may be secured by any number of means known to those skilled in the art, including, but not limited to cotter pins, snap rings, etc. In FIG. 1B, a collar latch 26 is depicted as holding collar sections 22A and 22B in a closed position about the vertical element 10. The collar latch 26 may be readily selected by those skilled in the art from any number of latch designs that are capable of being operated underwater, either manually or by remotely operated vehicle (ROV). Collar sections 22A and 22B are provided with at least one groove or notch section 28, which will serve to provide a placement point for the fiber optic umbilical, to be discussed below. It will be appreciated that the collar sections 22A, 22B, the pin 24 and latch 26 may be readily fabricated from metal, fiberglass, thermoplastic or other material suitable for the marine environment. Moreover, the collars may be coated with copper or other anti-fouling coating to prevent marine growth on the collars.

Multiple fiber optic umbilicals 40 are shown as being installed in collar 20. The fiber optic umbilical 40 provides an appropriate shield for the one or more fiber optic fibers 42 within each umbilical 40. The umbilical 40 may be constructed from an appropriate material, such as thermoplastic or other material. Each of the fibers 42 has at least one sensor 44 integrated therein and secured to the inner wall of the umbilical 40 by epoxy or some other suitable means. As noted above, the sensor 44 may be of the FBG or FP type. While fiber optic fibers 42 of FIG. 1A are shown with a single sensor 44, multiple sensors may be placed on a single fiber. This may be achieved by designing the FBG or FP sensor 44 to have an initial different wavelength response to the same light source as other FBG or FP sensors 44. Accordingly, any measurement of strain from the multiple sensors could be distinguished one from the other. The sensor umbilicals 40 are depicted as being within grooves 28 within the collar sections 22A and 22B. The umbilicals 40 are secured within the grooves 28 and to the collar sections 22A and 22B by means of umbilical latches 50. The latch 50 may be readily selected by those skilled in the art from any number of latch designs that are capable of being operated underwater, either manually or by ROV. It will be appreciated that the number of umbilicals 40 that may be deployed on collar 20 and may be a simple matter of engineering design. The sensor umbilicals 40 are then connected to a system (not shown) designed to monitor and record strains on the element 10. Moreover, the umbilical 40 may be used to shield multiple fibers 42, each having multiple sensors 44 thereon.

The collar 20 with umbilicals 40 already installed thereon may be lowered on a heave-resistant line from an appropriate work vessel. At the selected depth, the collar 20 and umbilicals 40 may be maneuvered into position about structure 10. The collars 20 may then be opened and closed about the structure 10 by means of divers or ROVs, depending upon the depth of installation. Further, installation of the collar or other support structure may be achieved utilizing an ROV together with a special installation system designed to permit the installation of multiple support structures in a single trip. U.S. Pat. No. 6,659,539, incorporated herein by reference in its entirety, describes a method and apparatus for installing multiple clamshell devices, such as collar 20, using Shell's RIVET™ system, commercially available from one or more Shell Companies. Utilizing the RIVET™, the collars 20 and umbilicals 40 would be loaded into the RIVET™, lowered to the desired position next to the structure 10 and RIVET™ arms would be activated to close the collar 20 sections about the marine element 10. An ROV can be used to activate the RIVET™ structure or it may be remotely activated. The ROV may also be used to close the collar latch 26, if required. Alternatively, a self-closing latch 26 may be used on collar sections 22A and 22B.

The monitoring system may be located on a structure or vessel above the water line. However, in many instances, the sensors may not be readily adjacent to a surface structure, making it impractical to have umbilicals 40 lead back to the surface structure for connection to the monitoring system. It is contemplated with respect to the present invention that the monitoring system may further include a subsea-based system. The subsea system would analyze and record the strain information much like a surface system. The information could be stored for periodic transmission from the subsea system to a surface based system or retrieval of data from the subsea system. This may be accomplished by means of short range electromagnetic transmission, acoustic transmission via transponders and receivers or simple data retrieval utilizing an ROV system. Alternatively, the monitoring and recording system could be based in a surface buoy tethered to the marine element. The surface buoy could be battery and/or solar powered to provide power for the monitoring system. Further, the surface buoy system could transmit information to a remote station. Thus, it would be possible to support a remote monitoring system away from a structure. It will be appreciated that the remote monitoring system disclosed therein could be utilized with any of the embodiments discussed herein.

Figure 2B:
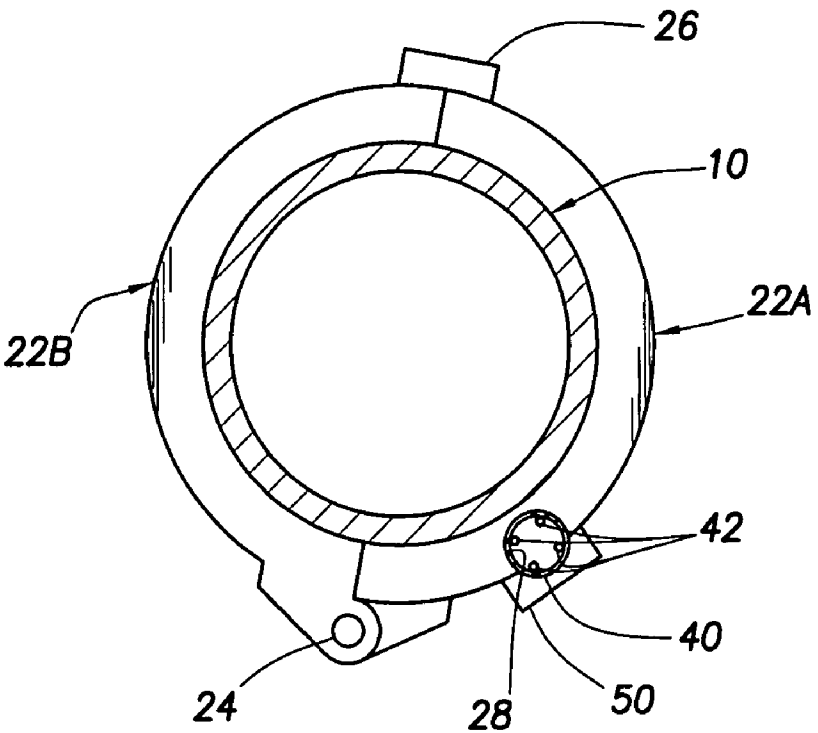
FIGS. 2A and 2B are side and top views, respectively, of a cutaway section of a tubular showing another embodiment of the present invention.
Figure 2A:
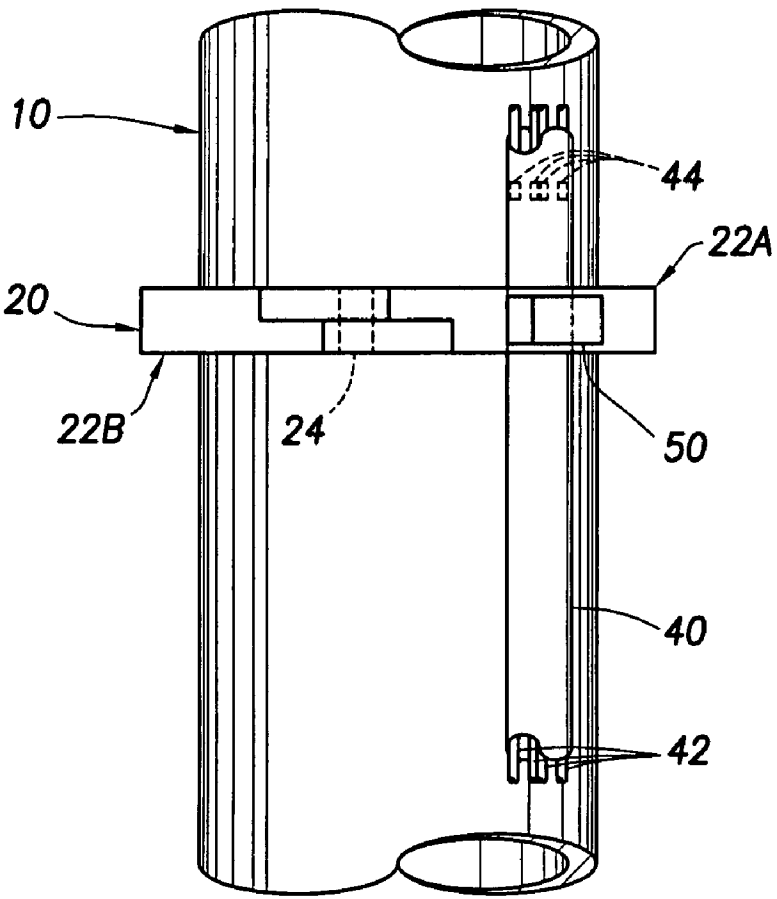
Figure 3:
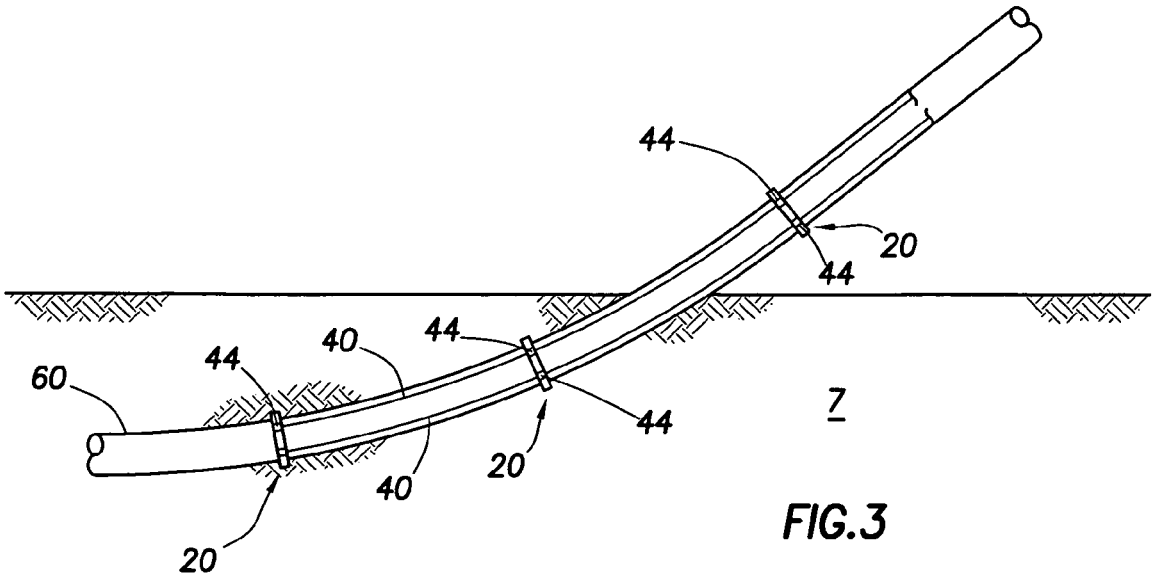
FIG. 3 is a perspective view of an application of the present invention showing spaced collars having multiple sensors on each fiber optic cable on an SCR.

FIGS. 2A and 2B depict side and vertical cutaways of another embodiment of the present invention. A collar 20, comprised of collar sections 22A and 22B, each having a mating hinge section incorporated therein are secured about marine element 10 by means of hinge pin 24 and latch 26. In the embodiment depicted in FIGS. 2A and 2B, a single groove 28 is incorporated into collar 20. An umbilical 40 is shown as being placed in groove 28 and secured within the collar 20 by means of a suitable latch 50. Whereas the umbilical 40 of FIGS. 1A and 1B had but a single fiber therein, the embodiment shown in FIGS. 2A and 2B depict multiple fiber optic fibers 42 therein, each having a sensor 44 bonded to the inside wall of the umbilical 40. The embodiment shown in FIGS. 2A and 2B depict each of the sensors 44 at approximately the same axial position within the umbilical 40. It will be appreciated that each fiber optic fiber 42 need not have its sensor bonded to the inside of the umbilical 40 wall in the same axial position. Moreover, more than one sensor 44 may be placed on a single fiber optic cable 42, as discussed above. The sensors 44 may be spaced azimuthally inside umbilical 40. Motion by marine element 10 in a specific direction will affect each sensor FIG. 3. is a perspective view of a marine element 60, in this case an SCR, on which a plurality of collars 20 and umbilicals 40 have been mounted in the touch down zone (TDZ), i.e., that portion of the riser where it comes into contact with the seabed 70. The implementation depicted in FIG. 3 utilizes multiple sensors 44 on a single fiber optic fiber 42 within umbilical 40. It will be appreciated, however, that the ability to detect a frequency shift created by FBGs, and therefore the strain seen by a particular sensor 44, will decrease as the number of sensors on a single fiber optic fiber increases. As a result, it may be desirable as the number of collars 20 installed on a structure increases, to have separate umbilicals 40 and/or fibers 42 on the collars 20.

Figure 4:
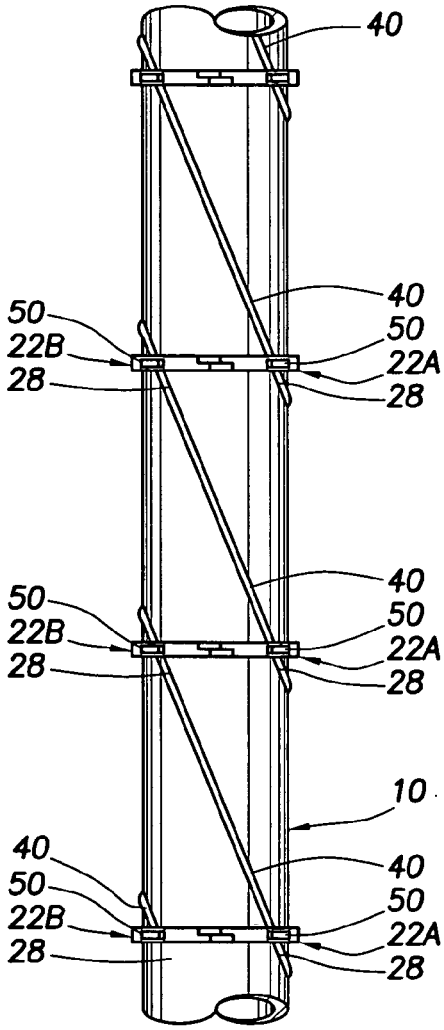
FIG. 4 is a side view of another application of the present invention is which the sensor umbilical is wound helically between the collars so as to sense vortex induced vibration.

FIG. 4 depicts a series of collars 20 placed on a vertical element 10. Unlike the alignment in shown in FIG. 1A, the umbilicals 40 are shown as being deployed in a helical manner by indexing each umbilical 40 over to the adjacent groove 28 in collar sections 22A and 22B. As noted previously, the umbilicals 40 are secured to the collar 20 by means of an umbilical latch 50. The umbilicals 40 may then be installed on collars 20 in a helical manner as shown in FIG. 4 using ROVs to place the umbilical 40 and close latch 50 to secure them to the collar 20. It is well known to those skilled in art that the installation of helical bodies about a larger body will have the result of suppressing VIV. At the same time, it will be appreciated that a single umbilical 40/sensor 44 combination that has failed during its operational life may be replaced by sending down an ROV to open the appropriate latch 50 on each collar to remove the defective umbilical 40/sensor 44 and replace it with an operational one.

Figure 5B:
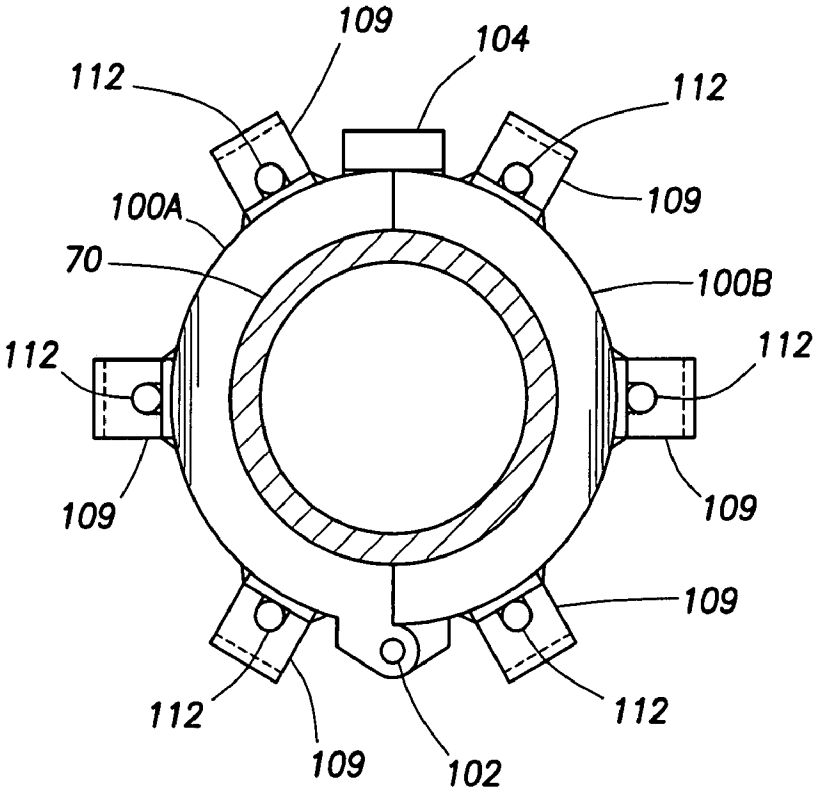
FIGS. 5A and 5B are side and top views of another embodiment of the present invention utilizing two locking collars.
Figure 5A:
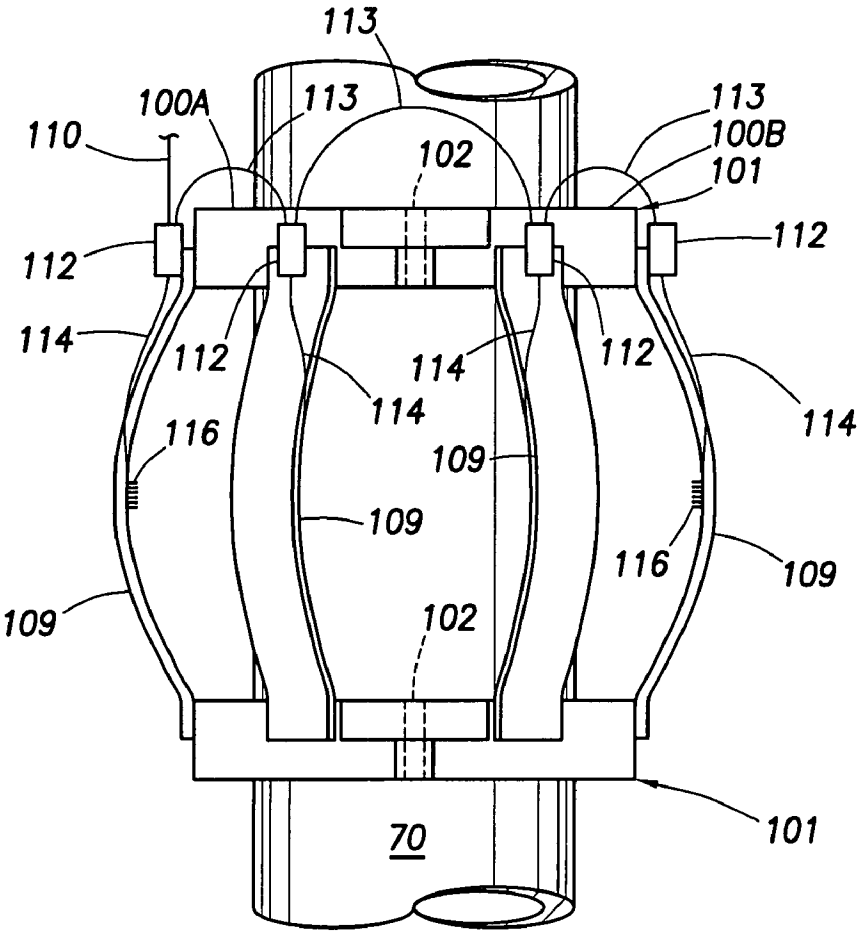

Another embodiment of the present invention is depicted in FIGS. 5A and 5B, in which a dual collar system utilizing spacer members placed between the collars. A marine element 70 is shown having two collars 101 placed at two different locations along the longitudinal axis of the tubular 70.

Each of the collars 101 are comprised of collar halves 100A and 100B and are free to rotate about pin 102. Each collar 101 is also equipped with a latch 104 to secure the collar halves 100A and 100B together. Strips of spacers 109 are show as being affixed to and connecting collars 101. The spacers 109 depicted in FIGS. 5A and 5B are shown as rectangular strips in compression between the collars 101. The spacers may also have other geometric configurations and may made from ABS plastic, PVC plastic, or other thermo plastics, soft metals, fiberglass or other materials that would permit the spacers 109 to flex sufficiently to place them in compression between collars 101. A fiber optic umbilical 110 attached to a surface monitoring system (not shown) is shown as being connected to fiber optic junction 112. Junction 112 may be affixed to one of the collars 100A or 100B or may be affixed to the spacer 109. The junction 112 shown in FIG. 5A is shown as being "daisy-chained" through fiber optic umbilical 113 to other similar junctions 112 mounted on the spacers 109. Each junction 112 further has a fiber optic sensor lead 114 leading away from the junction 112 and terminating in a FBG or FP sensor 116. FIG. 5A shows the sensor 116 as being mounted on the inside of spacer 109 to protect it from current borne objects. The sensor 116 may further be protected by means of epoxy, plastic or other suitable marine resistant coating. With the spacers 109 being under compression, any strain seen by marine element 70 will result in a change in the compression of the spacers 109. These changes may be detected by the sensors 116 and transmitted to the monitoring system. While FIG. 5A shows multiple junctions 112, it will be appreciated that a single fiber optic junction having multiple fiber optic sensor leads 114 may be used to place multiple sensors 116 on the spacers 109.

Figure 6B:
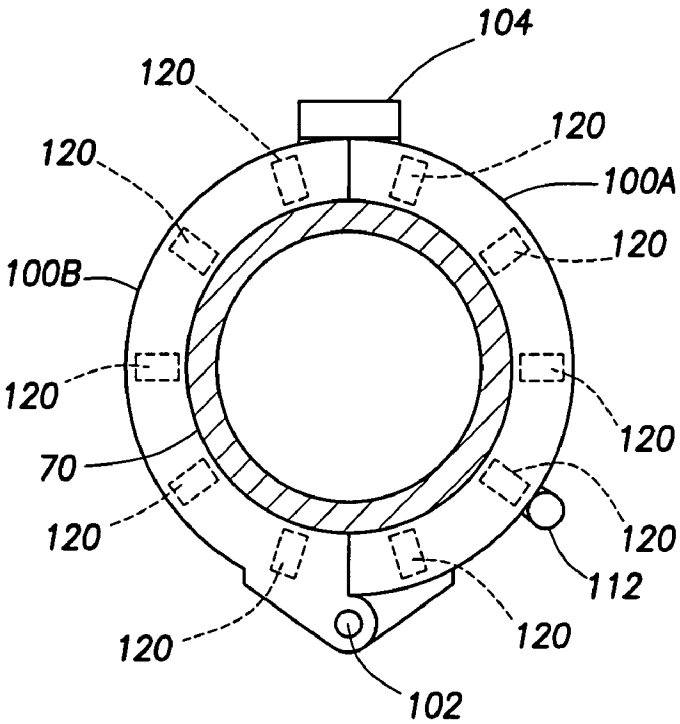
FIGS. 6A and 6B are side and top views of another two collar embodiment of the present invention.
Figure 6A:
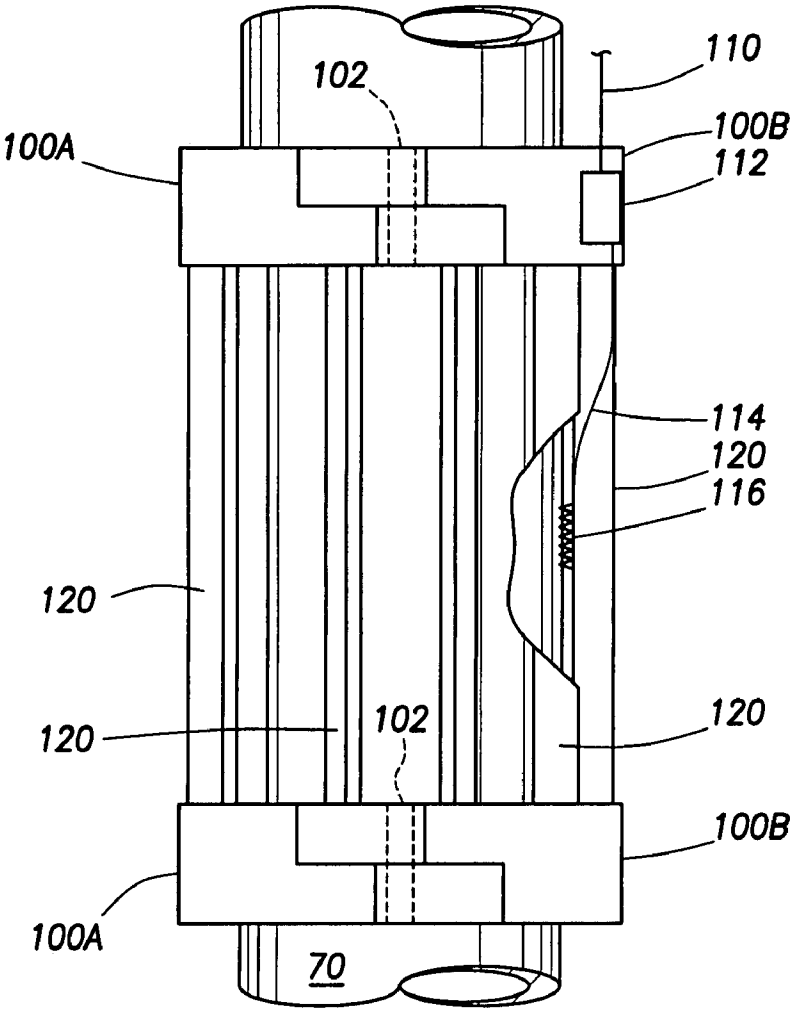

A variation of this spacer system for monitoring is shown in FIGS. 6A and 6B. Instead of flexible spacers 109 as used in FIGS. 5A and 5B, multiple spacer bars 120 are used as spacers between collars 100A and 100B secured about marine element 70. The spacer bars 120 may be placed in tension, compression or an unloaded condition between collars 100A and 100B. A fiber optic umbilical 110, attached to a surface monitoring system (not shown) is shown as being connected to a single fiber optic junction 112. Multiple fiber optic sensor leads 114 lead away from junction 112 and terminate in FBG or FP sensors 116 placed on the inside of spacer bars 120. Alternatively, multiple junctions 112 may be used similar to those depicted in FIGS. 5A and 5B. Strain seen by the marine element 70 will be transmitted via collars 100A and 100B to the spacer bars 120. The strain may be detected by the sensors 116, transmitted through junction 112, and fiber optic cable 110 to the surface system or another system, where it may be recorded. It will be appreciated that implementations depicted in FIGS. 5A, 5B and 6A, 6B may be installed utilizing the aforementioned RIVET™ system.

Figure 7B:
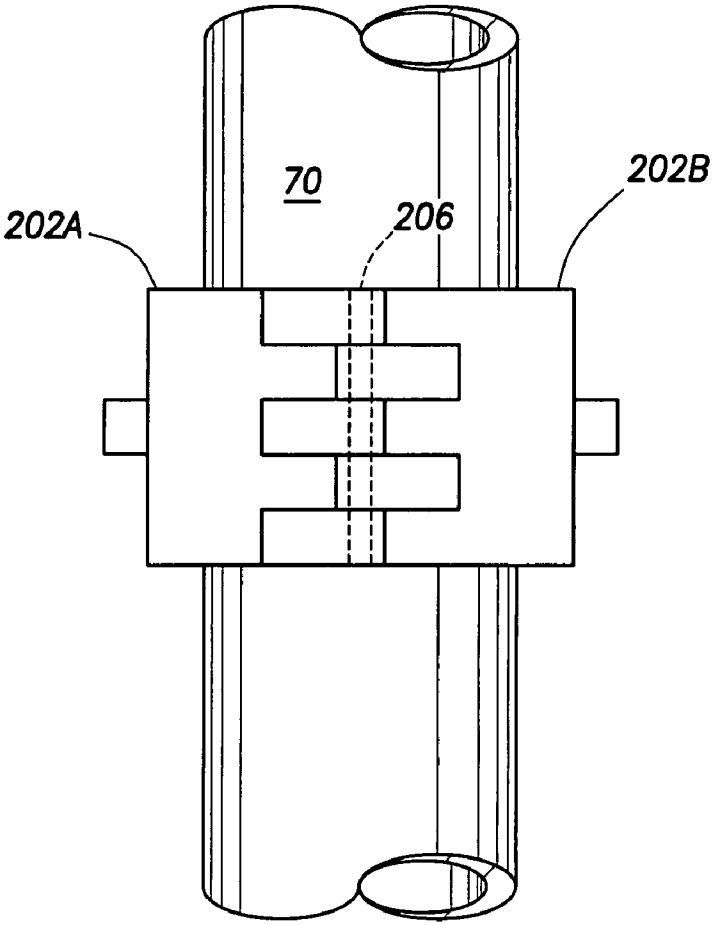
FIGS. 7A and 7B are top and side views of another embodiment of the present invention utilizing a bladder contact system.
Figure 7A:
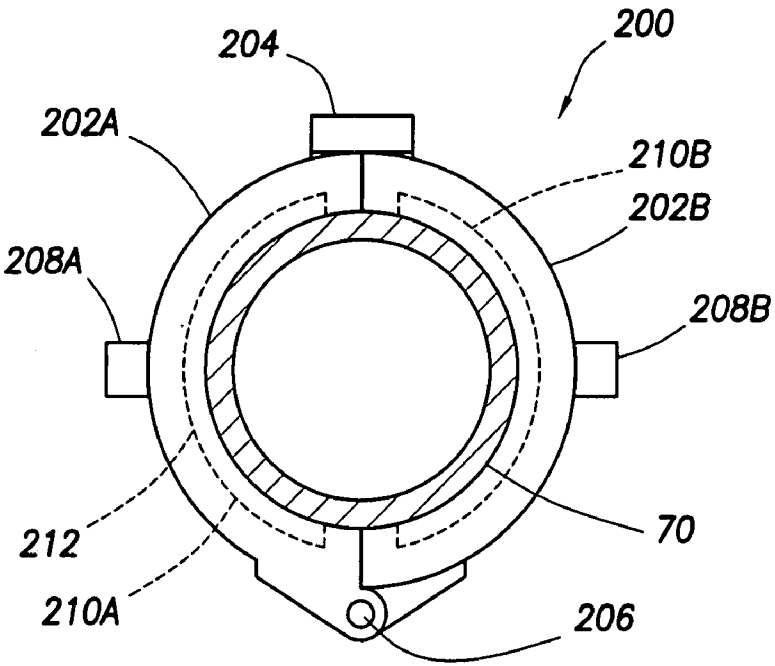

An alternative to mounting sensors on intermediate objects attached to a marine element is to mount the sensor directly on the marine element. However, retrofitting sensors directly to an installed marine element is generally difficult in assuring (a) placement and (b) contact between the sensor and marine element. FIGS. 7A and 7B depict the design of a collar system that permits a sensor to be directly in contact with an installed marine element. A single collar 200 is comprised of collar halves 202A and 202B pivoting about pin 206. The collar halves 202A and 202B are secured about the marine element utilizing a latch 204, for example a self-locking latch. Each collar half 202A and 202B may have at least one recess 212 therein for the mounting of an inflatable bladder 210A and 210B which is placed between the inside of the collar halves 202A and 202 B and the marine element 70. Each of the collar halves 202A and 202B is provided with an injection port 208A and 208B which are depicted in greater detail in FIGS. 9A-9C.

Figure 8C:
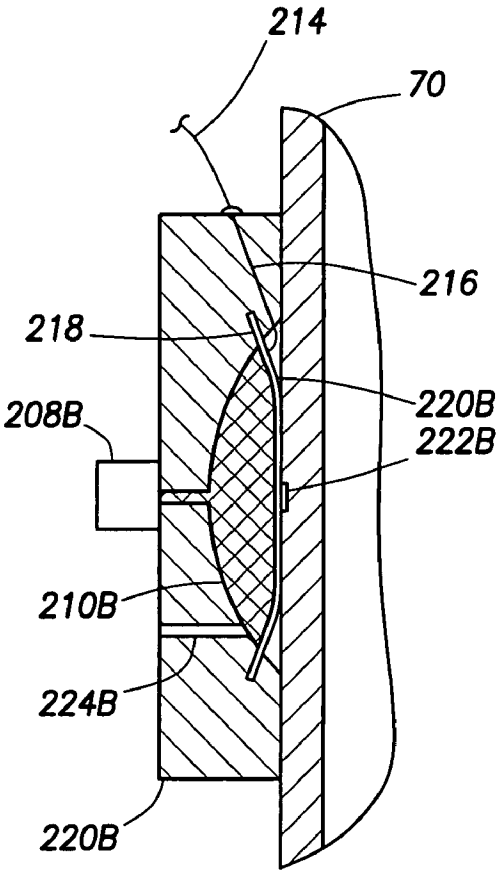
FIGS. 8A-8C are detailed views of the bladder and sensor contact system of FIGS. 7A and 7B.
Figure 8B:
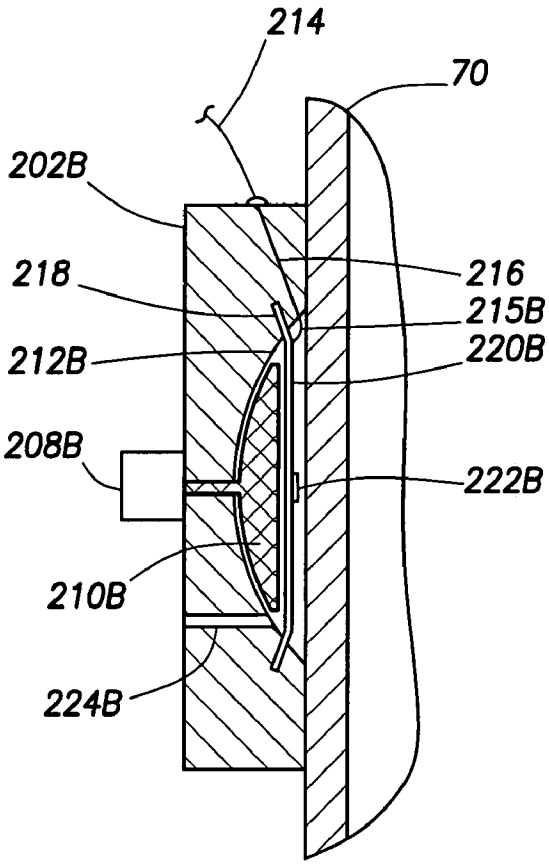
Figure 8A:
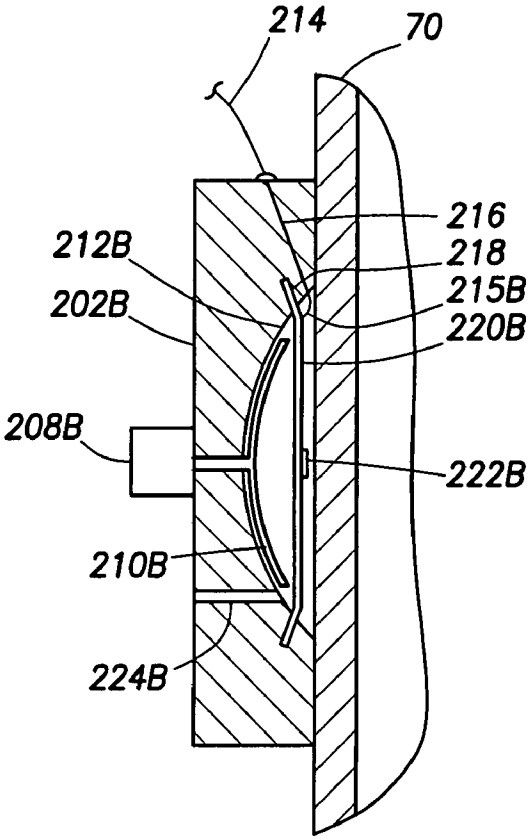

Collar 202B is shown in section and detail in FIGS. 8A-8C. It will be appreciated that collar 202A has similar detail but is not shown for the sake of brevity. Collar 202B has an annular chamber 212 machined azimuthally about the interior of the collar 202B. Inflatable bladder 210B is mounted in the recess 212 and is in fluid communication with port 208B. It will be appreciated that a check valve (not shown) may be placed in the fluid passage between bladder 210B and port 208B. A fiber optic umbilical 214 is depicted passing through access port 216 in collar 202B. The access port 216 may be sealed to the marine environment by means of epoxy, potting compound or other suitable substance. Chamber 212B further includes a flexible, non-corrosive carrier plate 220B bearing fiber optic strand 215B which terminates in a FBG or FP sensor 222B. As depicted in FIGS. 8A-8C, the carrier plate 220B is retained within the chamber by placing part of the plate within relief grooves 218 formed in the chamber 212. Other methods for retaining the carrier plate 220B may used such as leaf springs or other suitable retaining systems. A vent port 224B is further drilled in collar 202B and may further be provided with a check valve (not shown) to permit the flow of water from chamber 212B to the marine environment but prevent water from the marine environment from flowing back into the chamber 212B.

In operation, the collar 200 may be installed about a marine element 70 by a diver, ROV or ROV and RIVET™ system. As noted above, the latch 204 is designed to be self-locking to tightly fit collar 200 about the marine element 70. Following securing the collar 200 about the marine element 70, a diver or ROV may be sent down to the collar 200. An epoxy may be pumped into port 208B, which is in fluid communication with the bladder 210B. As can be seen in FIG. 8B, as the epoxy 240 enters the bladder 210B, the bladder 210B expands and starts to deflect towards the marine element 70, pulling the carrier plate 220B out of grooves 218B. Alternatively, the carrier plate 220B may be scored adjacent to where it is affixed to chamber, rendering it frangible across the scoring allowing it to part and move toward the marine element 70 as the bladder 210B is inflated by pumping in the epoxy 240. In FIG. 8C, the bladder 210B is shown as fully inflated with the sensor 220B in contact with the marine element 70. It will be appreciated that as bladder 210B is inflated, that it will displace water originally in annulus between chamber 212B and marine element 70. Accordingly vent port 224B is provided to permit the displacement of the water and the addition of a check valve can prevent the return of water back into the annulus through port 224. The pump is disconnected from port 208B and the epoxy 240 is allowed to cure. With fiber optic cable 214 in communication with a surface monitoring system, this embodiment provides for a direct contact between the marine element 70 and the sensor 222B. It will be appreciated that multiple carrier plates 220 and sensors 222 may be installed in the chamber 212B, either utilizing multiple cables 214 or a single cable and a fiber optic junction that leads to multiple sensors. While FIGS. 7A, 7B and 8A-8C depict two azimuthal bladders 210A and 210B, it will be appreciated that small individual bladders may be used for one or more sensors. This type of arrangement would require additional pumping ports or a flow system that permits selection and inflation of the individual bladders without over-pressurizing other bladders that could result in damage to the sensor. Other systems may be readily designed to advance the sensor 222 into contact with the marine element upon injection of epoxy or some other bonding fluid. For example, sensor 222 may be mounted on a rod recessed in a sleeve in port 208. Upon injection of epoxy through port 208, the rod bearing the sensor is advanced into contact with the marine element as epoxy continues to fill cavity 212 displacing any water through port 224. It will be appreciated that the embodiments depicted in FIGS. 1, 2 and 7-8 are designed to be secured around an existing marine element in a hinged or clamshell fashion that may use the RIVET™ tool for installation.

Figure 9C:
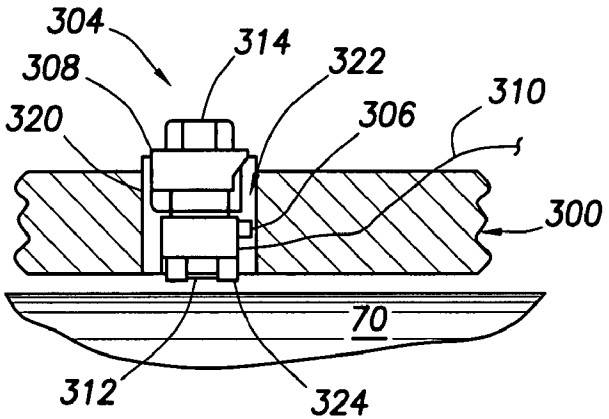
FIGS. 9A-9C are top, cross-sectional and detailed views of another embodiment of the present invention.
Figure 9B:
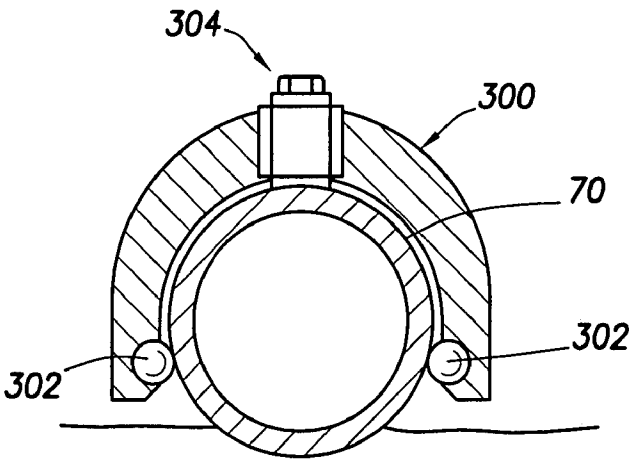
Figure 9A:
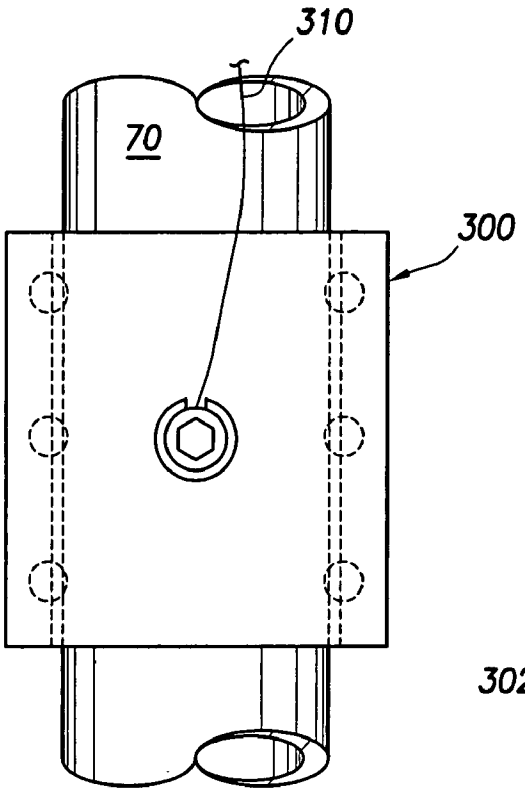

In other instances, a marine element may be horizontal or lying at or along the ocean bottom or partially embedded in the ocean bottom. It will be appreciated that it would be difficult, if not impossible, to install a fully encircling collar of the types disclosed above. Accordingly, there exists yet another embodiment to permit retro-fitting to horizontal and/or partially embedded marine elements. An embodiment for monitoring a partially embedded marine element 70 is depicted in FIGS. 9A-9C. FIG. 9A is a top view of the marine element having a shroud 300 disposed over the top of the marine element 70. The shroud 300 may be fabricated from fiberglass, thermoplastic, metal or other materials suitable for a marine environment. The shroud 300 may be lowered onto the marine element 70 from a surface vessel with the assistance of a diver or an ROV. The shroud 300 is secured to the marine element 70 by at least one spring-loaded (springs not shown), locking balls 302 installed in the interior of the shroud. As the shroud 300 lowered over the marine element 70, the spring loaded balls 302 are pushed back into shroud 300. As the shroud 300 is further lowered, the locking balls 302 pass the diameter of the marine element 70 and are then biased outwardly by the springs, thereby affixing the shroud 300 to the marine element 70. It will be appreciated that other retaining methods may be used to secure the shroud 300 to the marine element, including screws passing through shroud 300 that may be tightened about the marine element by a diver or an ROV. Alternatively, spring-loaded or screw-activated locking dogs may be used to secure the shroud 300 to the marine element 70. A sensor assembly 304, including fiber optic umbilical 310, is mounted atop the shroud 300. The fiber optic umbilical 310 is connected to an instrumentation system (either surface or subsurface) that is used to monitor and record the data.

The sensor assembly is shown in greater detail in FIG. 9C, which is a cross sectional view of the sensor assembly 304 and marine element 70. The shroud 300 is provided with a slotted hole 320, having slot portion 322 therein. A slotted sensor module 308 is designed to fit within threaded slotted hole 320. The module 308 has a key 306 manufactured therein and cooperates with slot 322 to align and limit the module 308 movement toward the marine element 70. The module 308 may be comprised of a potted epoxy thermoplastic, metal or other marine resistant material. The fiber optic umbilical 310 may be potted as part of the module and terminates in a FBG or FP sensor 312 mounted at the end of the module. Alternatively, a hole in the sensor module 308 or shroud 300 may be provided for passing the fiber optic cable 310 to the end of the sensor module. The sensor assembly 304 may further be provided with a grommet 324 or protective other means to protect sensor 312. The sensor module 308 is secured in slotted hole 320 by a lock down screw or bolt 314 that mates with the threads in slotted hole 320. The module 308 and grommet 324 may be designed to bring the grommet 324 into contact with the marine element 70 and thus permit the sensor 312 to directly monitor strain. Alternatively, if the sensor 312 is not in direct contact with the marine element 70, it will still be capable of monitoring the marine element 70 as large mechanical strains placed on the marine element will be passed to the sensor 312 through shroud 300. The illustrated embodiment thereby provides for a means for monitoring strains in elements that are horizontally situated or partially embedded.

Figure 10B:
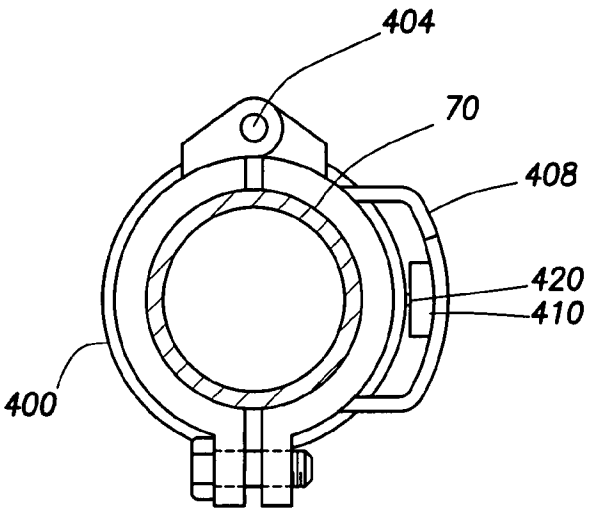
FIGS. 10A and 10B are side and cross-sectional views of another embodiment of the present invention.
Figure 10A:
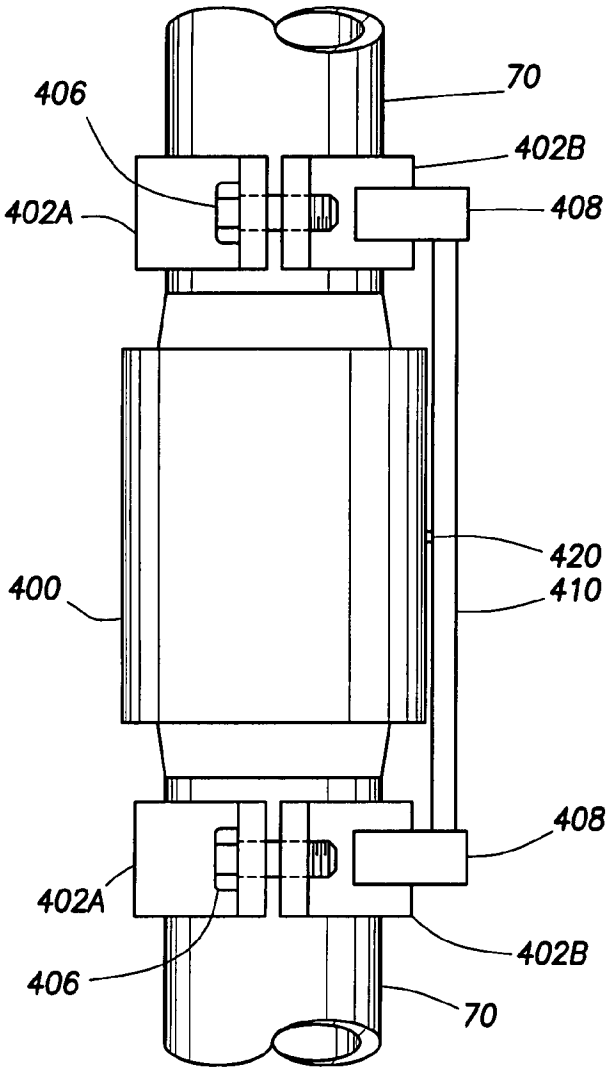

In other instances, it may be desirable to monitor the strain placed on a tubular or other connection. A system for carrying out monitoring is depicted in FIGS. 10A and 10B, which are side and cross-sectional views of such a system. Two tubular elements 70 are joined in a pin and box connection 400 in which the male threaded end of one of the tubulars is screwed into sealing engagement with the box end of the other tubular. In this embodiment collar halves 402A and 402B rotate about pin 404. In this instance, the assembly is made up of two collar sets, each disposed on one side of the connection 400. The respective collars may be secured by latches, bolts, machine screws 406 or other suitable retaining mechanism. A sensor support connection 408 is attached to each of the collars 402 by epoxy or other suitable means. The connections 408 are aligned to permit the attachment of a sensor support 410 prior to deployment. A fiber optic umbilical (not shown) is introduced such that a sensor 420 may be disposed in between the sensor support 410 and pin and box connection 400. This permits sensor 420 to directly monitor strain incurred by pin and box connection 400. While a single sensor is depicted in FIGS. 10A and 10B, it will be appreciated that multiple sensor supports 410 and sensors may be deployed using junction boxes and shown in FIGS. 5A and 5B.

Figure 11B:
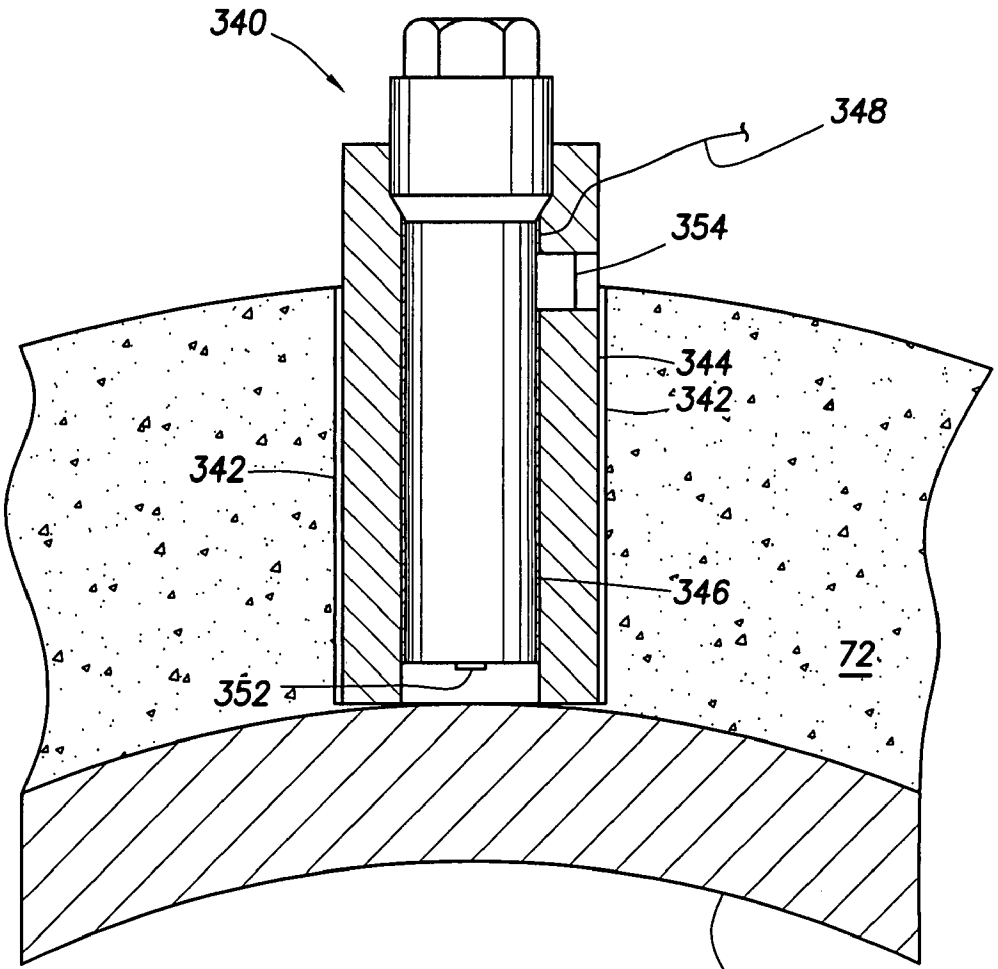
FIGS. 11A and 11B are cross-sectional and detailed views of another embodiment of the present invention as applied to concrete or cement coated structures.
Figure 11A:
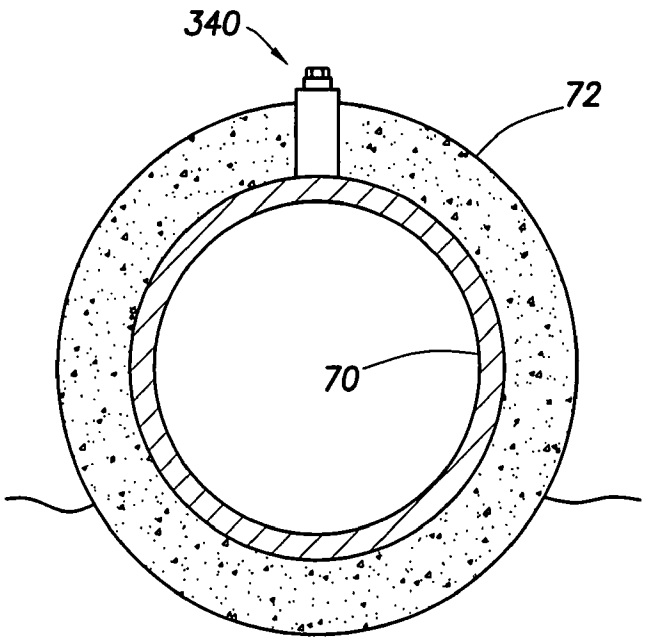

In some instances, a marine element 70, such as a pipeline, is coated with concrete to add extra weight and to prevent the pipeline from moving in response to near bottom currents. The present invention contemplates yet another embodiment to permit monitoring of concrete coated marine elements. In cross-sectional view FIG. 11A, a marine element 70 having a concrete coating 72 thereabout is shown in a horizontal position partially embedded in the surface. A sensor assembly 340 is depicted in FIG. 11A and shown in greater detail in FIG. 11B. A hole 342 is drilled and/or milled through the concrete coating 72. This may be accomplished by a diver or by using a work ROV equipped with a drill. It will be appreciated that a masonry drill and/or mill that is less capable of cutting into the steel of the marine element 70 may be used to prevent damaging marine element 70. Upon completion of drilling, a threaded, slotted sensor housing 344 may be inserted in the hole 342. The slotted sensor housing 344 is designed to receive a sensor module 346 having keyed portion 350 designed to mate with the slotted sensor housing 344 to align and position the sensor module 344. As with the embodiment of FIGS. 10A and 10B, the module 346 may be made of any suitable marine resistant material. The module 346 provides a pass-through or potted fiber optic cable 348 that terminates in a FBG or FP sensor 352 on the bottom of module 346. The module 346 is retained in the housing 344 utilizing a set screw 354 or other suitable means. The module 346 itself is retained within the concrete coating 72 by a quick setting epoxy 356 that is pumped into the annulus between the housing 344 and hole 342. Alternatively, a tapered sleeve or other friction retaining means may be used to retain the housing 344 within the hole 342. As will be noted in FIG. 11B, as illustrated, the sensor 352 is not in direct contact with the marine body 70. Rather, any strains will be transmitted through the cement coating 72, to the housing 344 and to the sensor module 346 and sensor 352.

Figure 12B:
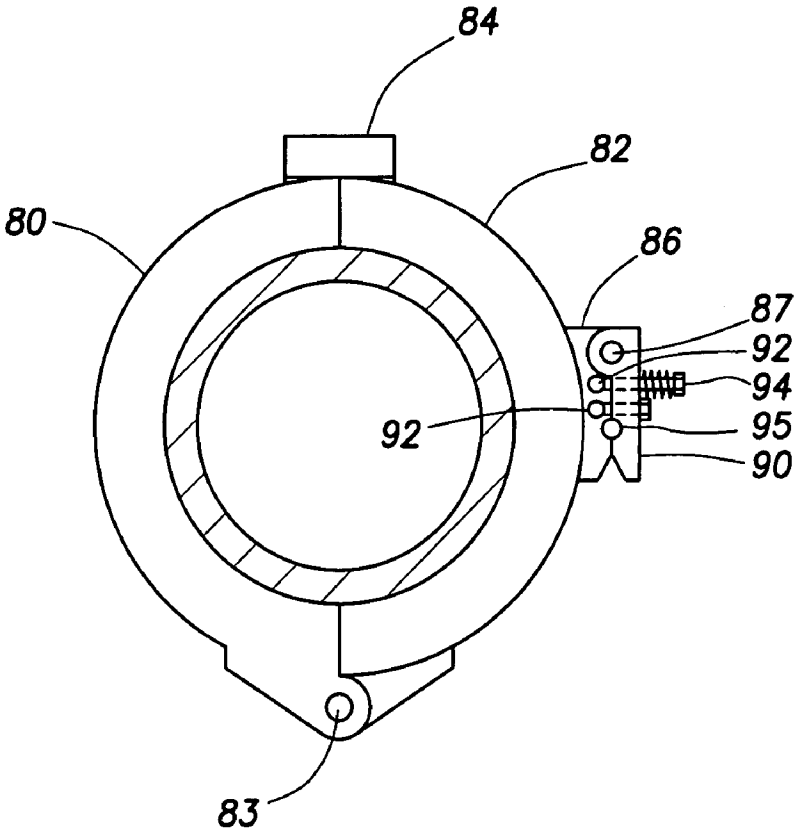
FIGS. 12A and 12B are side and cross-sectional views of the present invention as applied to a tubular connection.
Figure 12A:
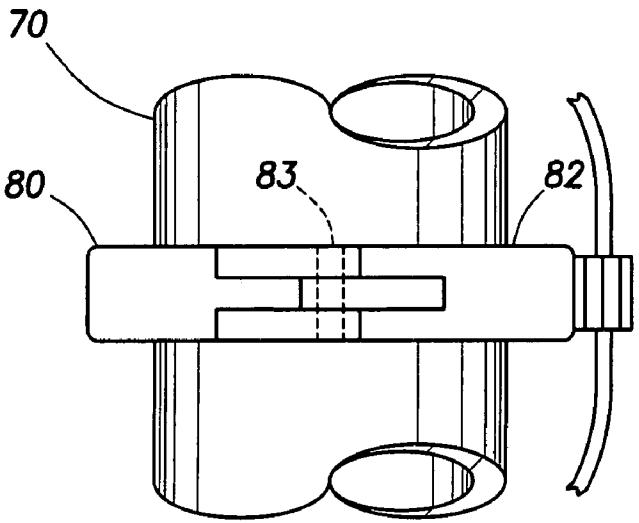

FIGS. 12A and 12B are cross-sectional and detailed views, respectively, of another single collar embodiment of the present invention. Two collar halves 80 and 82 pivot about pin 83. The collar halves 80 and 82 may be made of metal, thermoplastic or other materials suited to long term marine exposure. They are positioned about marine element 70 closed and secured by a suitable latch 84. A sensor base 86 is affixed to one of the collar (80 or 82) halves. The base 86 may be attached utilizing adhesives, resins, or may be welded to the selected collar half. One or more fiber optic cable grooves 92 are formed or machined in the sensor base 86. A locking latch arm 90 pivots about pin 86, which is in turn connected to sensor base 86. The locking latch arm 90 is drilled and threaded to receive contact pin 94. The contact pin 94 is used to insure that the fiber umbilical optic 94 having fiber optic cable 95 and FBG or FP sensor (not shown) remain in contact with the sensor base 86. In this instance, the collar may be installed on the tubular 70 prior to being installed in its location. The fiber optic umbilical 94 may be installed after the marine element 70 has been installed.

The present application has disclosed a number of different support structures that may be used to retrofit existing, in place marine structures with fiber optic monitoring equipment. As noted above, the fiber optic sensors may be used for the purpose of strain measurement, slug detection and temperature measurement. Various modifications in the apparatus and techniques described herein may be made without departing from the scope of the present invention. It should be understood that the embodiments and techniques described in the foregoing are illustrative and are not intended to operate as a limitation on the scope of the invention.

The invention claimed is:

1. A system for retroactively fitting a sensor and sensor communication system for monitoring an installed structural element, comprising:

at least one subsea support member comprising a clamshell device;

at least one sensor and sensor communication system adapted to be mounted on said at least one support member, said sensor communication system in communication with said sensor monitoring system;

means for remotely mounting said at least one support member on said structural element wherein physical changes in said structural element are transmitted to said sensor through said support member; and a recording system to record physical changes in said structural element.

2. The system of claim 1, wherein said sensor and sensor communication system is comprised of at least one fiber optic sensor and at least one fiber optic transmission cable.

3. The system of claim 2, wherein said at least one fiber optic transmission cable is a cable having multiple fiber optic strands therein.

4. The system of claim 2, wherein said at least one fiber optic sensor comprises a fiber Bragg grating sensor.

5. The system of claim 2, wherein said at least one fiber optic sensor comprises a Fabry Perot sensor.

6. The system of claim 1, wherein said at least one sensor further comprises: a non-fiber optic transducer for producing a signal measuring physical changes in said structural element; and a signal conversion means to convert said signal for transmission on said at least fiber optic transmission cable.

7. The system of claim 1, further comprising multiple fiber optic sensors wherein each of said sensors measures the direction of the strain, both circumferentially, longitudinally and hoop strain, and the magnitude of the strain.

8. The system of claim 1, further comprising multiple fiber optic sensors wherein said sensors measure temperature of said structural element.

9. The system of claim 1, wherein said structural element comprises: a pipeline structural element; and a plurality of fiber optic sensors arrayed along said pipeline, wherein said fiber optic sensors measure the relative density of the production passing through said pipeline.

10. The system of claim 1, wherein said recording system is comprised of a computer for recording and analyzing the measurements received from said at least one sensor.

11. The system of claim 1, wherein said support member is comprised of a clamshell device designed to close about said structural member.

12. The system of claim 11, further comprising: a second support member supported within said first support member, said at least one fiber optic sensor being mounted on said second support member; means for advancing said second support member once said clamshell device has been closed about said structural member, to bring said at least one fiber optic sensor into direct contact with said structural member.

13. The system of claim 11, further comprising: a support plate mounted within said support member, said fiber optic sensor being mounted on said support plate; an inflatable bladder; means for remotely inflating said bladder to advance said support plate toward said structural member to bring said fiber optic sensor in contact with said structural element.

14. The system of claim 11, further comprising: a support piston mounted within said support member, said fiber optic sensor being mounted on the end of said piston disposed toward said structural member; and means for advancing said support piston toward said structural member to bring said fiber optic sensor in contact with said structural element.

15. The system of claim 1, wherein said support member further comprises: a shroud supporting said at least one fiber optic sensor, said shroud being lowered over said structural support member; means for securing said shroud about said structural element.

16. The system of claim 11, further comprising: multiple clamshell devices secured about said structural member; multiple fiber optic sensors and multiple fiber optic transmission cables, wherein said multiple fiber optic transmission cables are secured to said multiple clamshell devices to form a helix about said structural member, wherein said helix is used to reduce vortex induced vibration.

17. The system of claim 1, wherein said structural element further comprises a coating surrounding said structural element; means for creating a passageway through the outside of said coating to said structural element; and means for mounting and securing said at least one fiber optic sensor and a least one fiber optic transmission cable within said passageway.

18. A method for monitoring physical changes on a subsea element, comprising:

providing a clamshell support element;

mounting at least one sensor and at least one sensor communication means on said clamshell device;

lowering said clamshell support element to said structural element;

securing said clamshell support element to said structural element, wherein physical changes in said structural element are transmitted to said at least one said sensor through said clamshell support element, said sensor generating an output signal; and recording said sensor output signals.

19. The method of claim 18, further comprising:

mounting a second support member within said clamshell support member, said at least one sensor and at least one fiber optic transmission cable being mounted on said second support member; and advancing said second support member to bring said at least one sensor into contact with said structural element following securing of said clamshell support device about said structural element.

* * * * *